US006425252B1

(12) United States Patent
Kobayashi et al.

(10) Patent No.: US 6,425,252 B1
(45) Date of Patent: Jul. 30, 2002

(54) PURGING METHOD, APPARATUS TO BE PURGED AND PURGING APPARATUS

(75) Inventors: Yoshinori Kobayashi; Akira Fujitaka, both of Shiga (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/367,037

(22) PCT Filed: Nov. 20, 1998

(86) PCT No.: PCT/JP98/05243

§ 371 (c)(1),
(2), (4) Date: Aug. 6, 1999

(87) PCT Pub. No.: WO99/31445

PCT Pub. Date: Jun. 24, 1999

(30) Foreign Application Priority Data

Dec. 16, 1997 (JP) ..... 9-363493

(51) Int. Cl.[7] ..... F25C 1/00
(52) U.S. Cl. ..... 62/77; 62/292
(58) Field of Search ..... 62/77, 292

(56) References Cited

U.S. PATENT DOCUMENTS 4,624,112 A * 11/1986 Proctor ..... 62/149
5,501,082 A * 3/1996 Tachibana et al. ..... 62/149
5,570,590 A * 11/1996 Hansen et al. ..... 62/472
5,582,019 A * 12/1996 Hanna et al. ..... 62/85
5,603,223 A * 2/1997 Murray et al. ..... 62/84
5,678,415 A * 10/1997 Peckjian et al. ..... 62/149
5,685,161 A * 11/1997 Peckjian et al. ..... 62/149
5,806,328 A * 9/1998 Muston et al. ..... 62/149
5,915,402 A * 6/1999 Mitchell, II ..... 137/15
5,941,082 A * 8/1999 Huang ..... 62/77
5,970,721 A * 10/1999 Kamimura et al.
6,016,661 A * 1/2000 Sagar ..... 62/149
6,029,472 A * 2/2000 Galbreath, Sr. ..... 62/475

* cited by examiner

*Primary Examiner*—William Doerrler
*Assistant Examiner*—Mark Shulman
(74) *Attorney, Agent, or Firm*—Armstrong, Westerman, Hattori, McLeland, & Naughton, LLP

(57) ABSTRACT

Disclosed is a purging apparatus for conducting an air purge required when an equipment such as a split type air conditioner is installed or repaired, and to a to-be purged apparatus and a purging method: a to-be purged apparatus having a to-be purged room with two or more valve openings capable of connecting to a main circuit or to a circuit other than said main circuit; and a purging apparatus having a replacing gas container into which a replacing gas to be exchanged for a to-be purged gas is previously charged and a gas collecting container for collecting gas including said to-be purged gas, one of said valve openings of said to-be purged room and said exchanger gas container can be connected with each other, and the other valve opening of said to-be purged room and said gas collecting container can be connected with each other; said method comprising the steps of: sending said exchanger gas in said exchanger gas container, thereby pushing out said to-be purged gas in said to-be purged apparatus; and collecting said to-be purged gas into said gas collecting container.

30 Claims, 14 Drawing Sheets

PURGING METHOD, APPARATUS TO BE PURGED AND PURGING APPARATUS

TECHNICAL FIELD

The present invention relates to a purging apparatus for conducting an air purge required when an equipment such as a split type air conditioner is installed or repaired, and to a to-be purged apparatus and a purging method.

BACKGROUND TECHNIQUE

Conventionally, in the case of a split type air conditioner, since its connecting pipes and its indoor heat exchanger are exposed to atmosphere and air exists therein, a purging operation for removing the air is required. Such an operation will be explained with reference to FIG. 25. In a general split type air conditioner, before it is installed, a refrigerant gas is charged in an outdoor unit 101. The outdoor unit 101 and an indoor unit 102 are connected using connecting pipes 103 by installing operation. After installing operation is completed, in order to remove the air existing in an indoor heat exchanger 104 and the connecting pipes 103, the refrigerant gas in the outdoor unit 101 is sent out from a 2-way valve 105 little by little to push out the air in the indoor heat exchanger 104 and the connecting pipes 103 to discharge the air from a service port 107 of a 3-way valve 106 which is another connection valve mounted to the outdoor unit 101.

Japanese Patent Application No. H9-133440 discloses a similar example of the purging method in a system using a refrigerant including hydro fluorocarbon as a working fluid. Constituent members having the same functions as those shown in FIG. 25 are designated by the same reference numerals, and explanations thereof will be omitted. As shown in FIG. 26, after the separate air conditioner is connected, a container 108 into which hydrocarbon gas having a pressure higher than atmospheric pressure is charged is connected to the service port 107. Another service port 110 capable of opening into atmosphere is mounted also to a connection 3-way valve 109 of the other outdoor unit. With this structure, the hydrocarbon gas is released into the system to push the inside air, and the service port 110 is opened into the atmosphere to conducting the air purge.

There is another method to remove non-condensation gas such as air by connecting a vacuum pump to the service port 107 in FIG. 25 to forcibly remove the inside air. This method is generally carried out in the installing and repairing operation.

However, according to the above-described conventional methods, the refrigerant gas which is sent out as an exchanger gas is discharged out into atmosphere at the time of air purge, which may adversely affect global environment such as global warming. Further, when the replacing gas (hereinafter sometimes referred to as exchanger gas) is a flammable material or a toxic material, there is a problem that such gas must be discharged out, which may bring a worker and the circumferential environment into an extremely dangerous state.

In view of the above problems, it is an object of the present invention to provide a purging method, a purging unit and a to-be purged unit which has a simple structure and which does not discharge the refrigerant gas to atmosphere when an equipment such as a split type air conditioner requiring the air purge is installed.

DISCLOSURE OF THE INVENTION

According to claim 1, a purging method uses: a to-be purged apparatus having a to-be purged room with two or more valve openings capable of connecting to a main circuit or to a circuit other than the main circuit; and a purging apparatus having a replacing gas container into which a replacing gas to be exchanged for a to-be purged gas is previously charged and a gas collecting container for collecting gas including the to-be purged gas, one of the valve openings of the to-be purged room and the replacing gas container can be connected with each other, and the other valve opening of the to-be purged room and the gas collecting container can be connected with each other; the method comprising the steps of: sending the replacing gas in the replacing gas container, thereby pushing out the to-be purged gas in the to-be purged apparatus; and collecting the to-be purged gas into the gas collecting container.

With this structure, by exchanging air in the to-be purged room to the replacing gas, it is possible to remove non-condensation gas such as air which may adversely affect the actual operation of the equipment. Further, a room of the replacing gas used for purging is collected into the gas collecting container together with the to-be purged gas and therefore, it is possible to prevent a material causing global warming such as refrigerant gas or a dangerous material such as flammable gas from being discharged into atmosphere.

According to claim 2, a to-be purged apparatus comprises a to-be purged room for exchanging a gas therein for a replacing gas, the to-be purged room having a valve opening for connecting with a main circuit and two or more valve openings for connecting with circuit other than the main circuit.

With this structure, the to-be purged apparatus has two or more valve openings, and if an arbitrary valve opening is selected and connected to the purging apparatus, the purging method in claim 1 can be realized.

According to claim 3, a purging apparatus comprises a replacing gas container into which a replacing gas to be exchanged for to-be purged gas is previously charged, and a gas collecting container for collecting gas including the to-be purged gas, one of valve openings of the to-be purged room and the replacing gas container, and other valve opening of the to-be purged room and the gas collecting container are capable of connecting with each other.

With this structure, there are provided the container in which the replacing gas to be exchanged for the to-be purged gas is charged and the gas collecting container for collecting the to-be purged gas partially having the replacing gas, it is possible to realize the purging method of claim 1 which does not discharge the replacing gas.

According to claim 4, the number of the valve openings is two, and the two valve openings are mounted at opposite ends of a pipe requiring purging operation. With this structure, since the farthest opposite ends among the to-be purged paths are provided with valve openings for connection with the purging apparatus, the gas can be exchanged without forming a stagnation of to-be purged gas in the to-be purged paths and therefore, the apparatus can be constituted using the minimum number of valves.

According to claim 5, the purging apparatus further comprises gas moving means for moving the replacing gas or the to-be purged gas. With this structure, gas in the system can easily be moved toward the gas collection container by providing the gas moving means in the path of the to-be purged room and therefore, it is unnecessary to excessively increase the pressure of the replacing gas in the replacing gas container for moving the replacing gas by the pressure difference, it is unnecessary to charge the replacing gas excessively, and a container and piping device which can withstand a high pressure are unnecessary.

According to claim 6, the gas collecting container is provided therein with a replacing gas adsorbing material inside for adsorbing the replacing gas and/or replaced gas (such as air or so). With this structure, since the replacing gas adsorbing material is contained in the gas collecting container, the replacing gas sent into the gas collecting container together with the to-be purged gas and adsorbed in the adsorbing material. Therefore, the pressure in the collection container is reduced by the adsorbed amount of the replacing gas, the internal pressure of the gas collecting container is correspondingly reduced, the to-be purged gas can be collected into the gas collecting container more easily and the purging operation can be carried out effectively.

According to claim 7, the gas collecting container is evacuated into vacuum or is depressurized. With this structure, since the pressure at the gas collecting container side is lowered, the pressure difference is generated and the replacing gas can be moved from the replacing gas container without using some devices of the replacing gas such as air pump, it is possible to carry out the purging operation without complicating the apparatus.

According to claim 8, a volume of the gas collecting container is variable. With this structure, since the volume of the gas collecting container is variable, the to-be purged gas in an amount pushed out by the replacing gas flows in the gas collecting container, the pressure in the container does not rise by the inflow gas and therefore, it is possible to smoothly collect the pushed out gas. Further, the gas collecting container need not be a pressure container, and the purging operation can be carried out smoothly with a simple apparatus.

According to claim 9, a volume of the replacing gas container is variable. With this structure, since the volume of the replacing gas container is variable, when the replacing gas therein is sent out by the purging operation by means of the gas moving means or the like, pressure in the container can be controlled so as to keep enough high pressure to push out the replacing gas and not become negative pressure. Therefore, opposite pressure is not applied to the gas movement, and the purging operation can be carried out smoothly.

According to claim 10, the same fluid as the gas in the main circuit is used as the gas. With this structure, since the replacing gas is the same as the working fluid, the gas does not affect the operation and performance of the equipment. Further, since a foreign material is not mixed, it is possible to enhance the reliability of the equipment.

According to claim 11, the purging apparatus further includes a volume control device capable of varying a volume of the replacing gas container. With this structure, it is unnecessary to dispose an expensive equipment such as the gas pump, the replacing gas can easily be sent out by the replacing gas container alone and therefore, it is possible to provide an inexpensive apparatus. According to claim 12, the purging apparatus further includes a value variable driving apparatus capable varying a volume of the gas collecting container. With this structure, it is unnecessary to dispose an expensive equipment such as the gas moving apparatus, the replacing gas can be easily collected and moved by the gas collecting container alone and therefore, it is possible to provide an inexpensive apparatus.

According to claim 13, a purging apparatus comprises a replacing gas room, a collection gas room and partitioning means for deviding both rooms separately, wherein the partitioning means varies the volumes of both rooms correspondingly. With this structure, the replacing gas container and the gas collecting container commonly use the container space, and if the replacing gas is sent out, a volume of the replacing gas container is reduced and a volume of the gas collecting container is increased by the same amount. Therefore, a volume of one of the replacing gas container and the gas collecting container suffices as a container space as the purging apparatus. Therefore, the apparatus can be made smaller, and the apparatus can easily be carried to a place where the purging operation should be carried out.

According to claim 14, the replacing gas room and the collection gas room are integrally formed in a container having a constant cross section, and the partitioning means is slidably movable. With this structure, if the partition mean between the replacing gas container and the gas collecting container is a thing like a piston which can be moved in its longitudinal direction, it is possible to provide a purging apparatus which can easily be worked and assembled in an actual manufacture of the apparatus.

According to claim 15, the purging apparatus according to claim 13 or 14, further comprises volume variable means for moving the partitioning means. With this structure, the purging operation can be carried out without the expensive gas moving means, sending the replacing gas and collecting the to-be purged gas can be conducted simultaneously. Therefore, the purging operation can be carried out effectively with a simpler apparatus.

According to claim 16, a pressure of the replacing gas is set to a value between 0.0 MPa and 0.2 Mpa at the temperature. Generally refrigerant for an air conditioner may be liquefied gas. According to the high pressure law, if pressure of liquefied gas is lower than 0.2 MPa, the replacing gas container need not be a pressure container. Therefore, the purging apparatus or the replacing gas container can be constructed by a simpler and inexpensive container. Further, the container can be lightened and can be carried easily.

According to claim 17, the purging apparatus further comprises pressure detecting means for detecting pressure in the replacing gas. With this structure, when the replacing gas is charged into the replacing gas container from, e.g., a gas cylinder before the purging operation, the gas can be charged while checking the charging pressure. Therefore, it is possible to prevent the excessive charging of the replacing gas, and to charge the replacing gas in a appropriate amount.

According to claim 18, the replacing gas container or the replacing gas room is provided with inflow pressure control means capable of controlling inflow pressure of the replacing gas to be charged. With this structure, by fixing the flowing pressure to the replacing gas container to a predetermined value, it is possible to automatically prevent the excessive charging, and to avoid the operation mistake at the time of charging.

According to claim 19 the replacing gas container or the replacing gas room is connected to the to-be purged apparatus through water removing means. With this structure, even if moisture is included in the replacing gas, it is possible to remove the moisture before the replacing gas is sent to the to-be purged apparatus. Therefore, it is possible to prevent the replacing gas including moisture from entering the air conditioner, and to prevent a trouble such as ice choke.

According to claim 20, the replacing gas container or the replacing gas room is connected to the to-be purged apparatus through a check valve for preventing backward flow of the gas. With this structure, it is possible to prevent the replacing gas which is once sent out of the replacing gas container from flowing backward into the replacing gas container and thus, to-be purged gas can be pushed out smoothly flow of the replacing gas in a constant direction.

According to claim 21, the gas collecting container or the collection gas room is connected to the to-be purged apparatus through a check valve for stopping the movement of gas in a direction from the to-be purged apparatus toward the gas collecting container or the collection gas room. With this structure, it is possible to prevent the to-be purged gas which is once collected from flowing reversibly toward the to-be purged room and thus, residue of the to-be purged gas can be reduced by keeping the flow of the to-be purged gas in a constant direction.

According to claim 22, a connection room of the replacing gas container or the replacing gas room with the to-be purged apparatus has a structure capable of sealing against atmosphere when the connection room is disconnected. With this structure, when the purging apparatus and the to-be purged apparatus are separated from each other after the purging operation, the replacing gas in the system should not flow out. For example, when the replacing gas includes flammable or toxic material, it is possible to provide a purging apparatus having a replacing gas container which can prevent the replacing gas from leaking and secure the safety.

According to claim 23, a connection room of the gas collecting container or the collection gas room with the to-be purged apparatus has a structure capable of sealing against atmosphere when the connection room is disconnected. With this structure, when the purging apparatus and the to-be purged apparatus are separated from each other after the purging operation, the replacing gas in the system should not flow out. For example, when the replacing gas includes flammable material or toxicity, it is possible to provide a purging apparatus having a gas collecting container which can prevent the replacing gas from leaking and secure the safety.

According to claim 24, a connection room of the to-be purged apparatus with the purging apparatus has a structure capable of sealing against atmosphere when the connection room is disconnected. With this structure, when the purging apparatus and the to-be purged apparatus are separated from each other after the purging operation, the replacing gas in the system should not flow out. For example, when the replacing gas includes flammable or toxic material, it is possible to provide a to-be purged apparatus which can prevent the replacing gas from leaking and secure the safety.

According to claim 25, the to-be purged gas that exists in the to-be purged room is air or gas including oxygen, a connection path between the gas collecting container or the collection gas room and the to-be purged apparatus is provided with oxygen gas detecting means, and the purging apparatus further comprises the first purge completion judging means for judging a completion of purging operation based on a signal from the oxygen gas detecting means. When the to-be purged gas is air in the air conditioner, if oxygen gas is continuously, intermittently or in the spot manner in the path connected to the collection gas cylinder, and if oxygen gas is not detected any more, it can be judged that gas in the to-be purged system is completely exchanged with the replacing gas. Therefore, more reliable purging operation can be carried out.

According to claim 26, the purging apparatus further comprises exchanger gas detecting means disposed in a connection path between the to-be purged apparatus and the gas collecting container or the collection gas room for detecting the replacing gas, and the second purge completion judging means for judging a completion of purging operation based on a signal from the replacing gas detecting means. With this structure, the replacing gas is continuously, intermittently or in a spot manner by the replacing gas detecting means disposed closer to the gas collecting container than the to-be purged room, and the replacing gas flowing into the gas collecting container is detected. Therefore, it is possible to confirm that gas in the to-be purged room is sufficiently exchanged to the replacing gas, and the completion of the purging operation can be judged reliable.

According to claim 27, the replacing gas is intermittently sent out from the replacing gas container or the replacing gas room. When the replacing gas is sent out continuously, to-be purged gas may stay in a certain part of the circuit of the to-be purged room, and there is a residue of the to-be purged gas in the system. Thereupon, by sending the replacing gas intermittently, the to-be purged gas staying is dispersed so as to prevent the gas from staying locally, and more reliable exchanging operation can be conducted.

According to claim 28, the replacing gas container or the replacing gas room is connected to one of connection valves of the to-be purged apparatus having a greater diameter.

With this structure, since the replacing gas is sent out in the form of gas, a pressure drop in the vicinity of the exit of the replacing gas container is smaller and exchanger gas can be sent out more smoothly when the gas is sent out from a larger valve opening than when the gas is sent out from a smaller valve opening. It is possible to prevent the generation of stagnation such as swirl which is prone to be generated when the diameter of the path is increased from thin pipe to thick pipe, and more effective gas exchange can be conducted.

According to claim 29, a flammable gas which does not generate harmful material when it is burned out is used as the replacing gas, and after the gas exchange is completed, the replacing gas in the to-be purged apparatus is burned.

With this structure, excessive exchanger gas in the to-be purged apparatus is burned outside, thereby evacuating and discharging the to-be purged apparatus, and the pressure therein can be reduced to substantially a constant pressure. Therefore, it is possible to control the replacing gas amount remaining in the to-be purged apparatus to approximately predetermined amount and thus, the amount of working fluid gas is not varied when a main circuit is utilized, and a designed capacity can be kept as it is.

According to claim 30, the purging apparatus further comprises pressure detecting means disposed in a path extending from the replacing gas container or the replacing gas room to the gas collecting container through the to-be purged apparatus for detecting pressure in the to-be purged room, and a sub-container connected to the path in parallel to the gas collecting container through valve.

With this structure, the replacing gas pressure in the to-be purged room can be adjusted with a simple structure, and it is possible to adjust the amount of the replacing gas remaining in the to-be purged apparatus due to the purging operation to a predetermined amount.

According to claim 31, the sub-container is evacuated into vacuum or is depressurized. With this structure, the adjusting region of the gas pressure in the to-be purged room can be enlarged, and it is possible to more accurately adjust the amount of exchanger gas remaining in the to-be purged apparatus due to the purging operation.

BEST MODE FOR CARRYING OUT THE INVENTION

Figure 1:
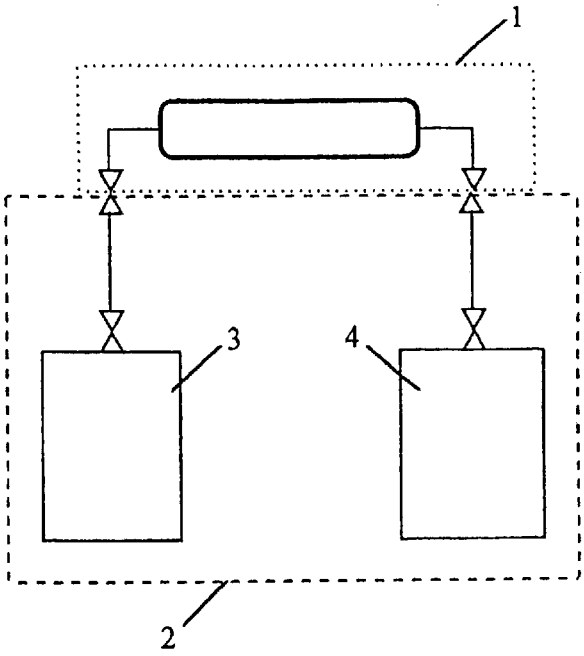
FIG. 1 is a conceptional block diagram of an apparatus showing a first embodiment of the present invention.
Figure 2:
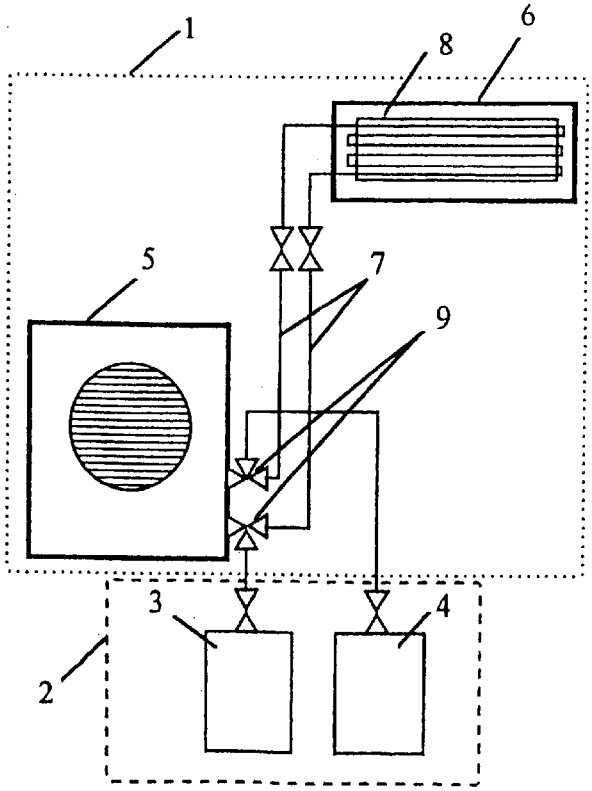
FIG. 2 is a block diagram of the apparatus showing the first and a second embodiments of the invention.

At First, the first embodiment of the present invention will be explained with reference to FIGS. 1 and 2. FIG. 1 a conceptional block diagram of a purging apparatus and a to-be purged apparatus for explaining a purging method of the present invention. In this method, a to-be purged apparatus 1 having a room in which a to-be purged gas is accumulated and a purging apparatus 2 having a replacing gas container 3 in which a replacing gas is charged and a gas collecting container 4 for collecting the to-be purged gas are connected to each other. A purging operation is carried out such that the replacing gas in the replacing gas container 3 is sent out in order to push out the to-be purged gas in the to-be purged apparatus 1, the pushed out to-be purged gas is collected in the gas collecting container 4 thereby removing the to-be purged gas which is unnecessary when the to-be purged apparatus 1 is used for its original purpose, the pushed out to-be purged gas and the replacing gas mixed thereinto are collected in the gas collecting container 4 so that the replacing gas is not discharged outside.

Next, the first embodiment will be described concretely with reference to FIG. 2. FIG. 2 is a schematic diagram of a split type air conditioner which an indoor unit and an outdoor unit are connected through connecting pipes using R22 as working fluid. When the split type air conditioner is used for the original purpose as an air conditioner, an outdoor unit 5 and an indoor unit 6 are connected to each other through connecting pipes 7 to constitute a "main circuit". However, before the system is run, it is removed to discharge "to-be purged gas" such as air in which the connecting pipe and indoor heat exchangers (to-be purged room) including the connecting pipe whose interior is exposed to atmosphere and a heat exchanger of the indoor unit. As a structure for discharging the to-be purged gas, the replacing gas container 3 in which the replacing gas is charged and the gas collecting container 4 are respectively connected to 3-way valves 9 mounted to the outdoor unit 5 of the air conditioner.

Next, procedure of the purging operation to be carried out in the above-described structure will be explained. The replacing gas is charged into the replacing gas container 3 at the pressure higher than atmospheric pressure. By opening the valve at the exchanger replacing gas container 3, the replacing gas in the replacing gas container 3 flows out into the to-be purged room by the pressure difference, thereby pushing out the accumulated air from the to-be purged room. On the other hand, the pushed out air flows into the gas collecting container 4, and a room of the replacing gas also flows into the gas collecting container 4. After the replacing gas is sufficiently sent out, the replacing gas container 3, the gas collecting container 4, and the 3-way valves 9 are closed so that the gas should not leak out, and they are separated again to complete the purging operation. With this operation, the to-be purged room is replaced with the replacing gas, and non-condensation gas does not exist therein.

Here, it is preferable that the replacing gas previously charged in the replacing gas container 3 is a refrigerant gas used for refrigeration, and examples of such gas are propane, fluoro carbon refrigerant, and it is preferable that such gas is charged in the replacing gas container 3 at a pressure higher than atmospheric pressure.

Although the present embodiment has been explained while taking the case of air conditioner, a scope of the present invention should not be limited to this only, and the present invention can be applied to an apparatus or an equipment which requires a purging operation in a wide sense.

Further, it is described that the to-be purged apparatus has at least two connection valves in the present embodiment, if the to-be purged circuit has a complicated structure and one pipe is diverged into many pipes and the pipe is used for such a purpose, the diverged pipes are also provided at their tip ends with valve openings. Therefore, if arbitrary two of the diverged pipes may be connected to the purging apparatus 2 for conducting the purging operation, the inside to-be purged gas can be exchanged in the same manner as the present invention.

Further, although the purging apparatus 2 comprises the exchanger gas container 3 and the gas collecting container 4, they need not be placed on the same pedestal, and it is possible to use them in different places in accordance with a required condition.

The collected to-be purged gas is divided into air and the replacing gas by an exclusive gas collecting apparatus, and is processed.

As described above, it is possible to remove the non-condensation gas such as air which adversely affects the actual operation of the equipment by exchanging the air in the to-be purged for the replacing gas, and a room of the replacing gas which was used for purging is collected in the gas collecting container together with the to-be purged gas. Therefore, it is possible to prevent a material causing global warming such as HCFC or flammable gas from being discharged into atmosphere.

Next, a second embodiment of the present invention will be explained with reference to FIG. 2 again, while taking the case of the split type air conditioner. In FIG. 2, the outdoor unit 5 and the indoor unit 6 are connected with each other using the connecting pipes 7 respectively. When the air conditioner is installed, since there is air in the connecting pipes 7 and the pipe of the indoor heat exchanger 8, it is necessary to purge the air in such room in order to use the air conditioner. Thereupon, when the purging is carried out in these rooms, the opposite ends of the to-be purged room which are most separated from each other are connection rooms of the connecting pipes 7 with the outdoor unit 5, and in the present embodiment, 3-way valves 9 are mounted to the connection rooms. At the time of the purging operation, the 3-way valves 9 are connected to the replacing gas container 3 and the gas collecting container 4, respectively. If the purging operation is carried out using these passages, there is no pipe in which air remains and therefore, the purging can sufficiently be carried out using only the two valves.

As described above, by providing the valve openings for connecting with the purging apparatus at opposite ends which are most separated rooms in the to-be purged passage, it is possible to exchange the gas without forming stagnation of the to-be purged gas in the to-be purged passage and therefore, it is possible to constitute the apparatus using the minimum number of valves for purging.

Figure 3:
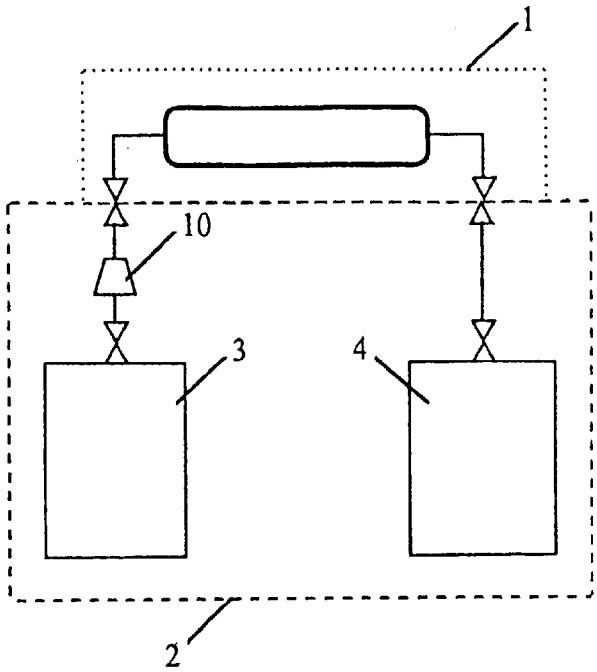
FIG. 3 is a block diagram of the apparatus showing third and fifth embodiments of the invention.

Next, a third embodiment of the present invention will be explained with reference to FIG. 3. In FIG. 3, a gas pump 10 as gas moving means is disposed on a connection passage between the replacing gas container 3 and one end of the to-be purged apparatus. A little amount of exchanger gas of a pressure of about 0.1 MPa (gauge pressure), for example, which should be enough quantity to push out inside air, is charged into the replacing gas container 3. With this structure of the apparatus, the purging operation is carried out such that the gas pump 10 is operated to send out the replacing gas in the replacing gas container 3 into the to-be purged room so to-be purged gas such as air is pushed out.

With the above structure, since the gas in the to-be purged room can easily be moved toward the gas collection container by providing the gas moving means in the passage of the to-be purged room, it is unnecessary to move the replacing gas using the pressure difference by excessively increasing the pressure of the replacing gas in the gas collecting container and therefore, it is unnecessary to charge the excessive exchanger gas, and a container and a piping apparatus which can withstand a high pressure are unnecessary.

Figure 4:
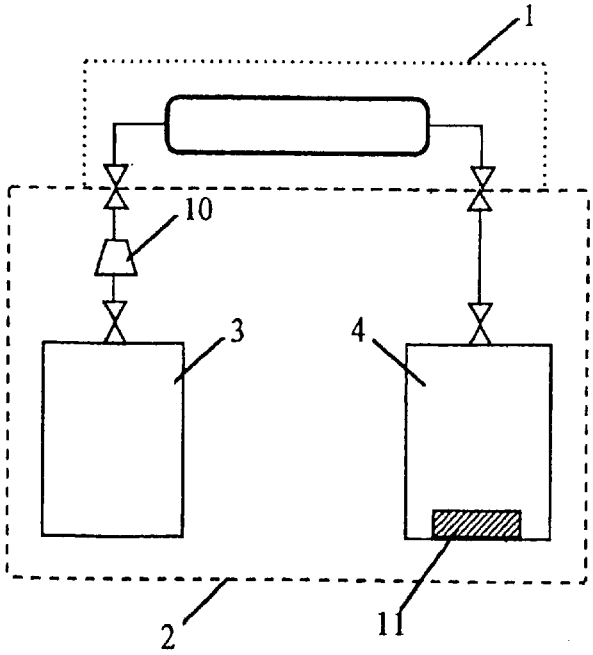
FIG. 4 is a block diagram of the apparatus showing a fourth embodiment of the invention.

Next, a fourth embodiment of the present invention will be explained with reference to FIG. 4. As shown in FIG. 4, a replacing gas adsorbent 11 made of, e.g., silica gel or porous material is contained in the gas collecting container 4. The to-be purged gas pushed by the replacing gas during the purging operation is collected into the gas collecting container 4 together with a room of the replacing gas. The exchanger gas collected in the gas collecting container 4 can be adsorbed by the replacing gas adsorbent 11 and therefore, the pressure in the container is correspondingly lowered by the adsorbed amount, which makes it easy to collect the to-be purged gas.

With the above structure, since the replacing gas adsorbent is contained in the gas collecting container, the replacing gas sent out into the gas collecting container together with the to-be purged gas is adsorbed by the adsorbent, the pressure in the container is correspondingly lowered by the adsorbed amount, which makes it easy to collect the to-be purged gas. Therefore, the purging operation can be carried out more effectively.

Next, a fifth embodiment of the present invention will be explained with reference to FIG. 3 again. In the present embodiment, in FIG. 3, the gas collecting container 4 is previously evacuated before operating purging. With this structure, a pressure of the to-be purged gas at the side of the gas collecting container 4 becomes lower, the collection of the gas becomes easy correspondingly, and the replacing gas sent out from the replacing gas container 3 can be moved smoothly.

With the above structure, since the pressure of the to-be purged gas at the side of the gas collecting container 4 becomes lower, a pressure difference can be generated without using the gas pump and, the replacing gas can be pushed out the replacing gas container and therefore, the purging operation can be carried out without complicating the apparatus.

Figure 5:
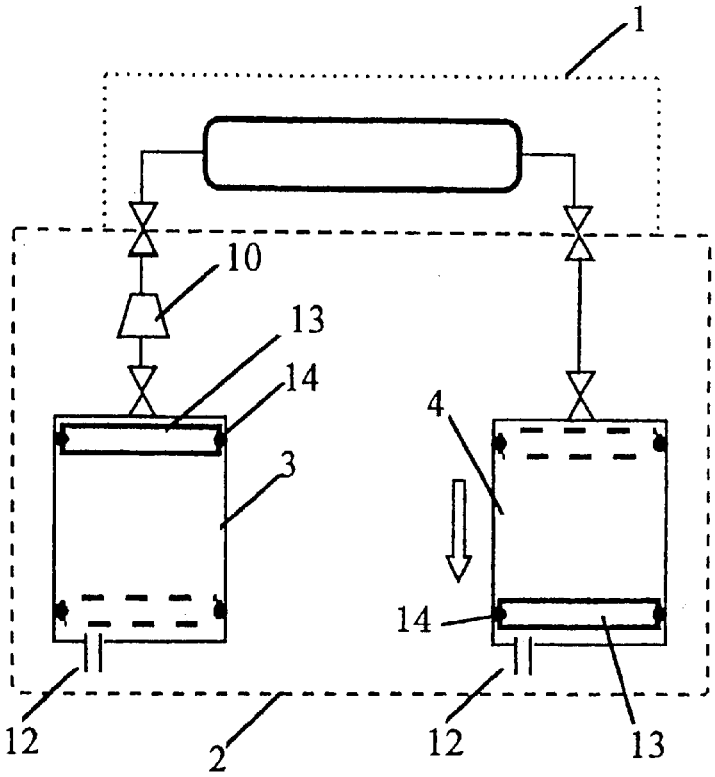
FIG. 5 is a block diagram of the apparatus showing sixth and seventh embodiments of the invention.

Next, a sixth embodiment of the present invention will be explained with reference to FIG. 5. In FIG. 5, the replacing gas container 3 and/or the gas collecting container 4 is cylindrical shaped having a constant cross section, and is provided at its bottom with a hole 12 communicated with atmosphere. A piston 13 is longitudinally movably received in the container. The piston 13 defined the replacing gas container 3 or the gas collecting container 4 into a to-be purged room side and an atmosphere side by a seal material 14.

Next, one example of the purging operation using this apparatus will be explained. A replacing gas having a pressure slightly higher than atmospheric pressure is previously charged into the replacing gas container 3. At that time, as the replacing gas is charged, the piston 12 enlarges the volume of the room in which the replacing gas is contained, and when the piston 12 enlarges the space volume to the maximum level, it stops at the bottom of the container. On the other hand, in the case where the gas collecting container 4 includes the piston 13, when the gas collecting container 4 is connected to the to-be purged apparatus 1, the piston 13 is pulled up to an upper surface of the gas collecting container 4 so that the volume of a chamber at the side in which the to-be purged gas flows in becomes zero. From this state, if the gas pump 10 is operated, the replacing gas in the replacing gas container 3 is sent out to push out the to-be purged gas into the gas collecting container 4.

At that time, as the replacing gas is sent out, a pressure in the chamber containing the replacing gas at the side of the replacing gas container 3 is lowered compared to the state before and thus, the piston 12 rises to reduce the volume. That is, even if the replacing gas is sent out, the replacing gas container 3 is not evacuated as compared with a closed container and therefore, the replacing gas is moved smoothly, and the gas pump 10 is not evacuated easily. On the other hand, as the to-be purged gas flows in the gas collecting container 4, the piston 13 is lowered to enlarge the gas collection space so that the internal pressure is substantially kept at atmospheric pressure. Therefore, a counterpressure is not easily applied from the gas collecting container 4 toward the to-be purged room, and gas is smoothly collected.

At least one of the replacing gas container 3 and the gas collecting container 4 has the above-described structure, the above-described effect can be obtained as compared with a normal hermetic container, and the purging operation can be carried out more effectively.

An amount of the replacing gas to be charged into the replacing gas container 3 may be adjusted in accordance with a volume of the to-be purged room. If a volume of the replacing gas container 3 is smaller than that of the to-be purged room, a pressure of the gas may be slightly increased, and if the volume of the replacing gas container 3 is greater than that of the to-be purged room on the other hand, a less amount of gas may be charged.

With the above structure, since a volume of the gas collecting container 4 is variable, the to-be purged gas flows in the gas collecting container 4 in an amount corresponding to an amount of pushed out exchanger gas during the purging operation, the pressure in the container is not increased by the inflow of the gas and therefore, it is possible to smoothly collect the pushed gas.

Further, the gas collecting container 4 need not be a pressure container and thus, the purging operation can smoothly be carried out with a simple apparatus. Further, since the volume of the replacing gas container 3 is variable, when the interior exchanger gas is sent out by the gas moving means or the like, the pressure in the container is not brought into lower pressure which may pull the replacing gas back so that a counterpressure is not applied to the gas flow, and the purge operation can be carried out smoothly.

Figure 6:
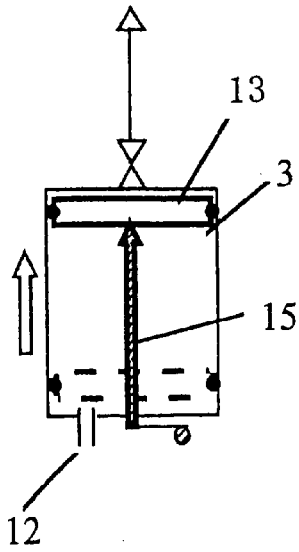
FIG. 6 is a block diagram of a replacing gas container of the seventh embodiment of the invention.
Figure 7:
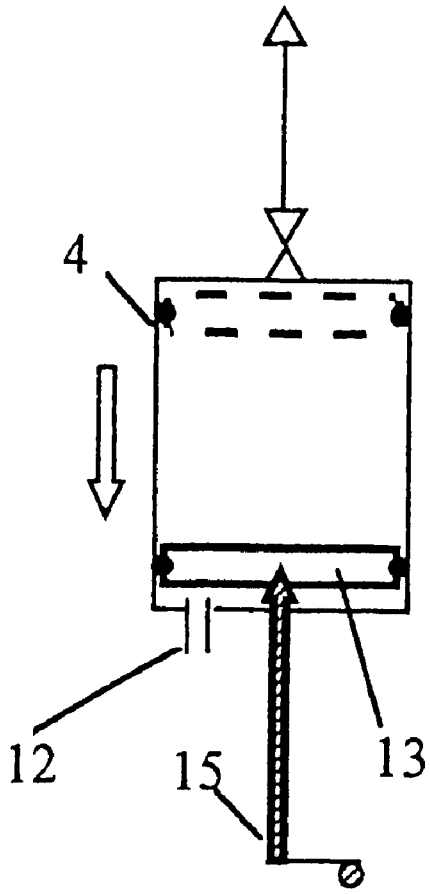
FIG. 7 is a block diagram of a gas collecting container of the seventh embodiment of the invention.

Next, a seventh embodiment of the present invention will be explained with reference to FIGS. 5 to 7. First, an improvement of the replacing gas container 3 will be explained. In FIG. 6, the present seventh embodiment is different from the sixth embodiment in that a volume variable driving apparatus 15 (here, for example,it is a screw type handle) for directly acting on the piston 13 to vertically move the piston 13, and the gas pump 10 is unnecessary in the purging apparatus 2. As means mounted in a pipe for moving the gas, the gas pump 10 is general means.

However, in the present embodiment, the replacing gas container 3 is worked, the piston 13 is moved using the screw type handle 15 for example, the replacing gas in the replacing gas container 3 is directly sent out, thereby moving the to-be purged gas or the replacing gas, also without using a high cost device such as the pump 10. With the above structure, it is unnecessary to provide a high cost equipment such as the gas moving apparatus, the replacing gas can easily be sent out only at the side of the replacing gas container 3 and therefore, an inexpensive apparatus can be provided.

Next, an improvement of the gas collecting container 4 will be explained.In FIG. 7, the present seventh embodiment is different from the sixth embodiment in that a volume variable driving apparatus 15 (here, it is a screw type handle) for directly acting on the piston 13 to vertically move the piston 13, and the gas pump 10 is unnecessary in the purging apparatus 2. As means mounted in a pipe for moving the gas, the gas pump 10 is general means. However, in the present embodiment, the gas collecting container 4 is worked, the piston 13 is moved using the screw type handle 15 for example, a volume of a space in which the to-be purged gas in the gas collecting container 4 enters is enlarged, thereby moving the to-be purged gas or the replacing gas, without using a high cost device such as the pump 10.

With the above structure, the to-be purged gas can easily be sent out only at the side of the gas collecting container 4 and therefore, an inexpensive apparatus can be provided.

Next, an eighth embodiment of the present invention will be explained. According to the present embodiment, the to-be purged apparatus is a split type air conditioner using R410A as a working fluid. As the working fluid, R410A is used as the replacing gas which is previously charged in the replacing gas container 3. As the replacing gas, a refrigerant gas other than R410A, such as R32, R125 or R290 having a component of the R410A may be used. However, if a gas such as R290 is used in this air conditioner, such a gas may adversely affect a air-tight used in the equipment or an insulation material of a compressor motor. Further, if R32 or R125 having the same component as R410A is used alone as the replacing gas, there is a possibility that the gas may become a working fluid different from a desired charging component, and it may adversely affect the performance of the system. Especially when a flammable refrigerant such as R32 is used as one component like in R410A is used as in the replacing gas, there is a possibility that R410A which should be a non-flammable material may changed into a flammable composition as a whole. Therefore, ascending to the working fluid of the system if the replacing gas has the same component as that of the working fluid, these problems can be solved.

With the above reasons, since the replacing gas is made of exactly the same material as that of the working fluid, this should not adversely affect the operation and performance as an equipment, and since a foreign material is not mixed in the replacing gas, it is possible to enhance the reliability of the equipment very easily without optional test to check the reliability.

Figure 8A:
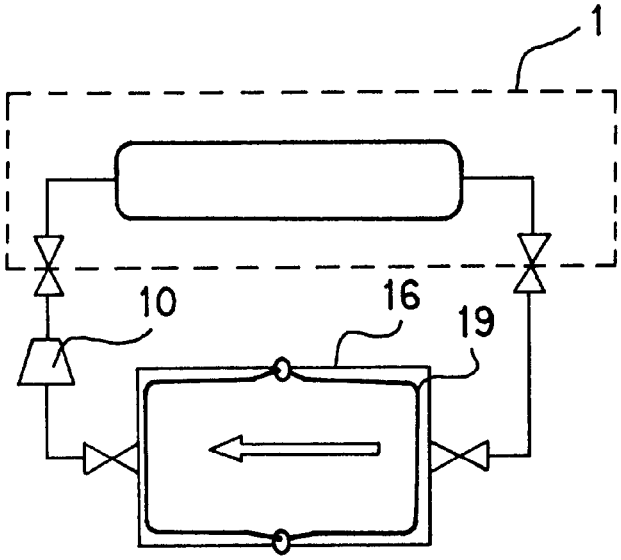
FIG. 8 is a block diagram of the apparatus showing a ninth embodiment of the invention.
Figure 8B:
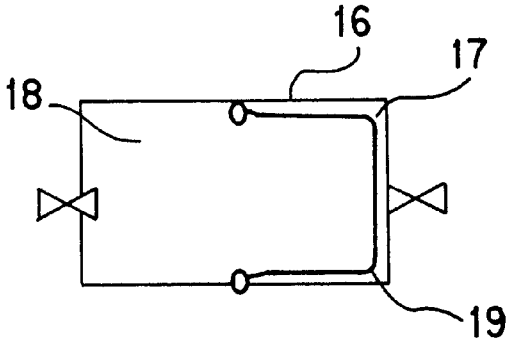
Figure 8C:
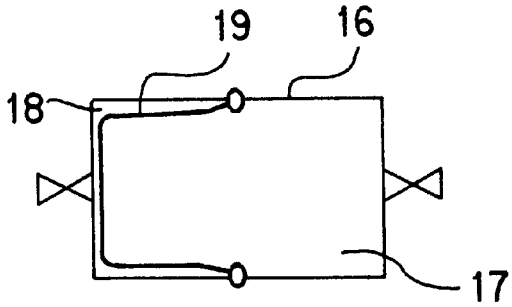

Next, a ninth embodiment of the present invention will be explained with reference to FIGS. 8(*a*) to 8(*c*). First, in FIG. 8(*a*), the present embodiment is characterized in that the replacing gas container and the gas collecting container are integrally formed to constitute an integral container 16, and the integral container 16 is defined into two chambers 17 and 18 by partitioning means (such as gas impermeable film) 19.

Next, the procedure of the purging operation will be explained. As shown in FIG. 8(*b*), the replacing gas is charged in the replacing gas chamber 18 of the integral container 16 at the side of the gas pump before the purging operation is started. When the purging operation is started, the replacing gas in the replacing gas chamber 18 is sent out into the to-be purged room through the gas pump 10, the volume of the replacing gas chamber 18 is reduced, and the volume of the collection gas chamber 17 is enlarged, so that the to-be purged gas is sucked and collected. Therefore, a load on the gas pump 10 becomes smaller, and the gas can be collected more effectively. Further, since the replacing gas chamber 18 and the collection gas chamber 17 commonly use the same space, it is possible to reduce the volume down to about one half as compared with a case where the replacing gas container and the gas collecting container are independently provided and therefore, it is possible to reduce the size of the purging apparatus.

With the above structure, the replacing gas container and the gas collecting container commonly use a container space as the integral container 16, the volume of the replacing gas container is reduced by a sent out amount of the replacing gas, and the volume of the gas collecting container is increased by the same amount. Therefore, a volume of one of the replacing gas container and the gas collecting container will suffice for the container space as the purging apparatus, which can reduce the size of the apparatus, and it is possible to bring the apparatus easier to a site where the purging operation should be carried out.

Figure 9:
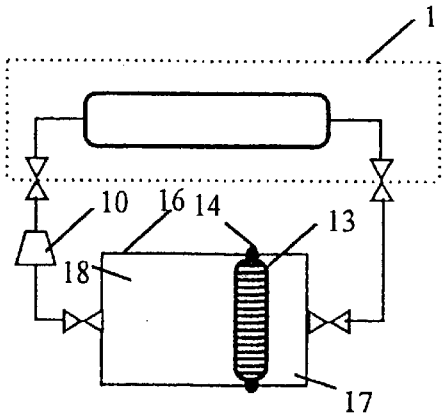
FIG. 9 is a block diagram of the apparatus showing a tenth embodiment of the invention.

Next, a tenth embodiment of the present invention will be explained with reference to FIG. 9. In FIG. 9, the present tenth embodiment is different from the eighth embodiment in that the integral container 16 is a cylindrical container having a constant cross section, and a partition between the replacing gas chamber 18 and the collection gas chamber 17 is a piston 13 which is movable in its longitudinal direction. The procedure of the purging operation is the same as that of the eighth embodiment, but the present embodiment is superior to the eighth embodiment in working property of the apparatus itself and practicality.

As described above, the partitioning plate between the replacing gas container and the gas collecting container is constituted by the piston 13 movable along the cylinder and therefore, it is possible to provide a purging apparatus which can easily be worked and assembled in an actual formation of the apparatus.

Figure 10:
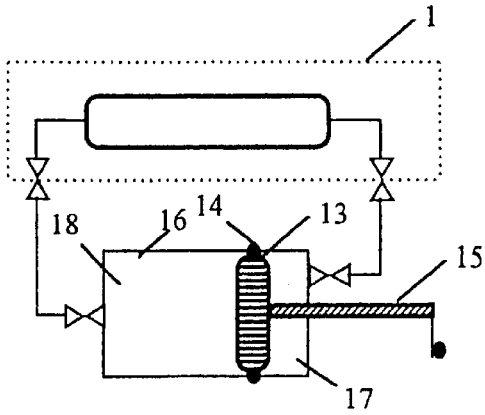
FIG. 10 is a block diagram of the apparatus showing an eleventh embodiment of the invention.

Next, an eleventh embodiment will be explained with reference to FIG. 10. In FIG. 10, the present eleventh embodiment is different from the ninth embodiment in that a volume variable driving apparatus 15 (here, it is a screw type handle) for directly acting on the piston 13 to move the piston 13 in the longitudinal direction, and the gas pump 10 is unnecessary in the purging apparatus. As means mounted in a pipe for moving the gas, the gas pump or the like is general means. However, in the present embodiment, the piston 13 is directly moved using the screw type handle 15 or the like, the replacing gas in the replacing gas chamber 18 is sent out, and a volume of a space in which the to-be purged gas of the collection gas chamber 17 enters is enlarged, thereby flowing smoothly to the to-be purged gas or the replacing gas, without using a high cost device such as the gas pump.

With the above structure, the purging operation can be carried out without providing the high cost gas moving means, and the sending out operation of the replacing gas and the collecting operation of the to-be purged gas can be carried out simultaneously. Therefore, the purging operation can be carried out more effectively with a simple structure of the apparatus.

Next, a twelfth embodiment of the present invention will be explained. According to the high pressure law of high pressure gas, it is necessary that a container for liquefied gas having a pressure equal to or greater than 0.2 MPa (gauge pressure) must be a pressure-resistant container which is restricted by the law. In this case, the pressure-resistant container tends to be heavier and more expansive in view of keeping enough strength and receiving examination. Therefore, by setting the pressure of the replacing gas to be previously charged in the replacing gas container to a value equal to 0.0 MPa or greater but smaller than 0.2 MPa, it is unnecessary to use the pressure-resistant container and therefore, it is possible to constitute the apparatus which is more inexpensive and lighter in weight.

Figure 11:
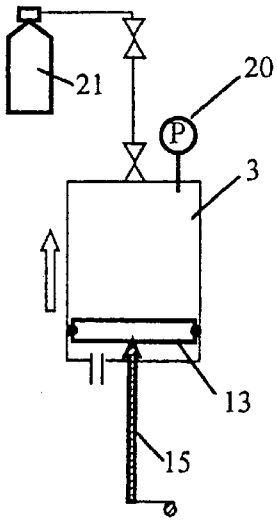
FIG. 11 is a block diagram of the apparatus showing a thirteenth embodiment of the invention.

Next, a thirteenth embodiment of the present invention will be explained with reference to FIG. 11. In FIG. 11, a Bourdon pressure gauge 20 capable of measuring the pressure of the replacing gas is mounted to the replacing gas container 3. During the operation for charging the replacing gas into the replacing gas container 3 from a replacing gas cylinder 21 before the purging operation, if the replacing gas is charged while checking the Bourdon pressure gauge 20, it is possible to control the amount of the replacing gas at a predetermined, necessary pressure, and it is possible to easily prevent excessive charging or insufficient charging.

With this above structure, when the replacing gas is charged into the replacing gas container from, e.g., the replacing gas cylinder 21 before the purging operation, the gas can be charged while checking the charging pressure, the excessive charging of the replacing gas can be prevented, and it is possible to charge the replacing gas in an appropriate amount.

Figure 12:
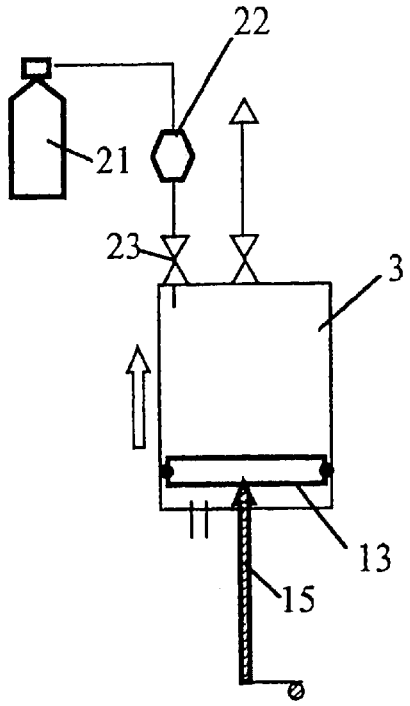
FIG. 12 is a block diagram of the apparatus showing a fourteenth embodiment of the invention.

A fourteenth embodiment of the present invention will be explained with reference to FIG. 12. In FIG. 12, the replacing gas is charged to the replacing gas container 3 from the replacing gas cylinder 21 through the regulator 22. In this case, the replacing gas is charged from the charging port 23 through the regulator 22 capable of adjusting the gas pressure at the outlet of this regulator to a predetermined pressure. With this structure, it is possible to charge the replacing gas to the replacing gas container 3 at a predetermined necessary pressure without fail, and the excessive charge or insufficient charge can be prevented easier.

With the above structure, the excessive charging is automatically prevented by fixing the inflow pressure to the replacing gas container 3, and an operating miss during the charging can be avoided.

Figure 13:
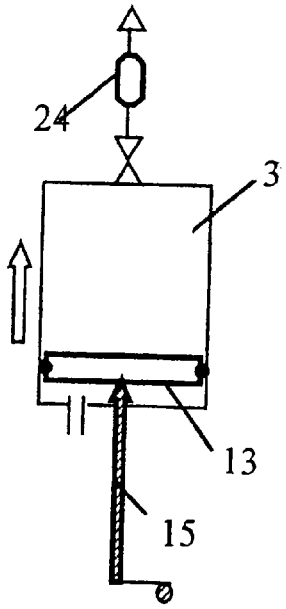
FIG. 13 is a block diagram of the apparatus showing a fifteenth embodiment of the invention.

Next, a fifteenth embodiment will be explained with reference to FIG. 13. In FIG. 13, a filter dryer 24 for adsorbing water is provided in a sending out pipe of the replacing gas container 3. Zeolite or silica gel, for example, is charged as absorbent in the filter dryer 24. If water should be mixed in the replacing gas, water enters the pipe by the gas exchange during the purging operation. If, for example, the purging apparatus is an air conditioner having a compressor, and polyol ester based oil used as refrigeration oil, there is a high possibility that a lubricant is hydrolyzed by the slight amount of water which may cause abrasion of the compressor due to decrease in lubricity. Further, moisture may be coagulated around an exit or the like of an expansion apparatus where temperature may go down to under 0° C. in a certain case, which may cause an ice choke, and the operation of the apparatus may be hindered. Therefore, the replacing gas is sent through the filter dryer 24 so as to prevent moisture or water from entering the system, thereby preventing water from being mixed in the gas.

With the above structure, even if water is included in the replacing gas, such water can be removed before the replacing gas is sent to the to-be purged apparatus, thereby preventing the water from entering the air conditioner, and a trouble such as ice choke can be prevented.

Figure 14:
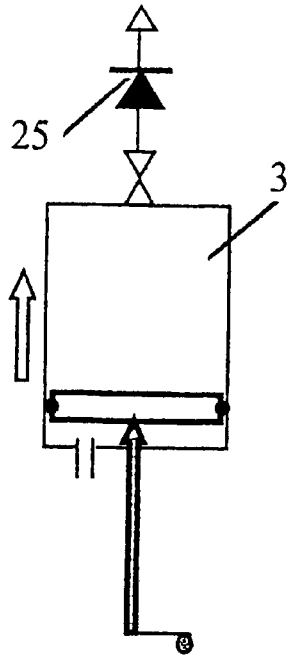
FIG. 14 is a block diagram of a replacing gas container side a sixteenth embodiment of the invention.
Figure 15:
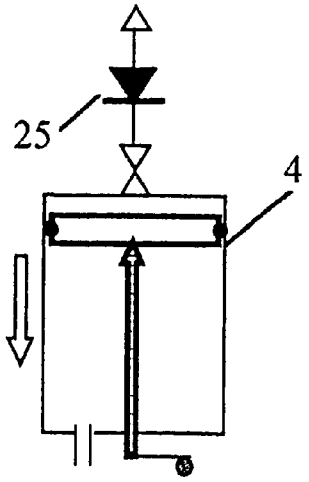
FIG. 15 is a block diagram of a gas collecting container side showing the sixteenth embodiment of the invention.

Next, a sixteenth embodiment of the present invention will be explained with reference to FIGS. 14 and 15. First, in FIG. 14, a check valve 25 is mounted to the replacing gas container 3 at the gas sending side for preventing the gas from flowing backward from the to-be purged apparatus toward the replacing gas container 3. Further, in FIG. 15, the check valve 25 is mounted to the gas collecting container 4 at the gas entering side for preventing the gas from flowing backward from the gas collecting container 4 toward the to-be purged apparatus. With such a structure, gas which is once sent out from the replacing gas container 3, and to-be purged gas or gas mixture of the to-be purged gas and the replacing gas which is once sent into the gas collecting container 4 should not flow backward. Therefore, air should not be mixed in the replacing gas of the replacing gas container 3, or the to-be purged gas of the gas collecting container 4 should not return to the to-be purged apparatus again, so that the purging operation can be carried out more effectively. Although the replacing gas container 3 and the gas collecting container 4 have been described as separate containers in the present embodiment, the same effect can be obtained even if these two containers are integrally formed such as the integral container shown in FIG. 8(*a*), and the present embodiment should not be limited to the separated containers only.

With the above structure, it is possible to prevent the replacing gas which is once sent out from flowing backward to the replacing gas container 3, and to keep the flow of the replacing gas in a constant direction, thereby reducing the residue of the to-be purged gas.

Further, it is possible to prevent the to-be purged gas which is once collected from flowing backward to the to-be purged room, and to keep the flow of the to-be purged gas in a constant direction, thereby reducing the residue of the to-be purged gas in the to-be purged room.

Figure 16A:
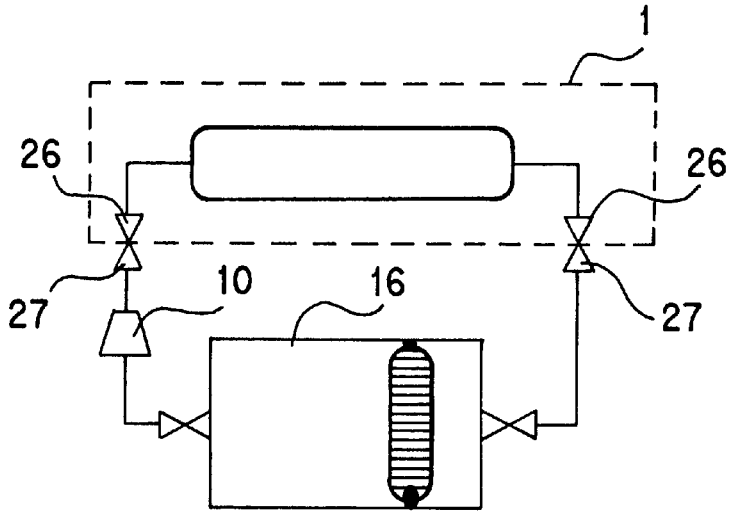
FIG. 16 is a block diagram of the apparatus showing a seventeenth embodiment of the invention.
Figure 16B:
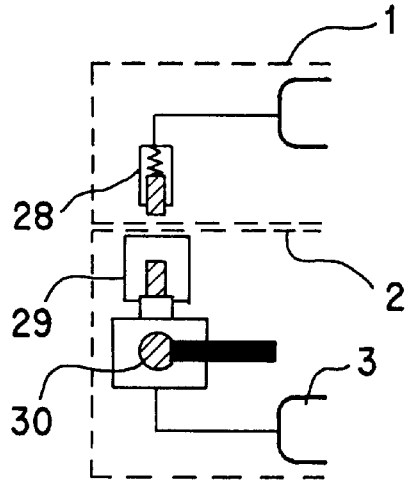
Figure 16C:
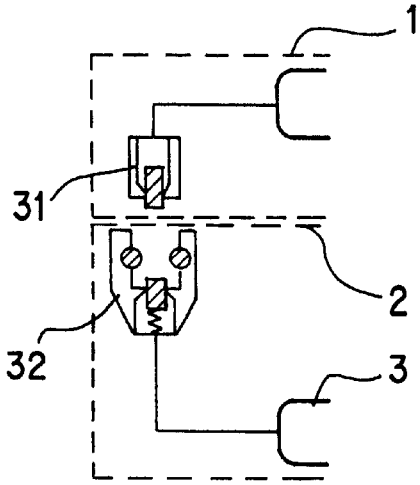

Next, a seventeenth embodiment of the present invention will be explained with reference to FIGS. 16(*a*) to 16(*c*). First, in FIG. 16(*a*), the present embodiment is characterized in that the to-be purged room 1 and the integral container 16 are connected to each other through valves 26 and 27 capable of closing with respect to atmosphere. For connecting the to-be room 1 and the integral container 16, a check pin 28 is used at the side of the to-be purged room 1, and a manual ball valve 30 and a connection room 29 capable of connecting with the check pin 28 and pushing and opening a plug of the check pin 28 are used at the side of the replacing gas container 3 as shown in FIG. 16(*b*). At that time, it is preferable that a distance between the connecting room 29 and the ball valve 30 is as short as possible. When the connecting room 29 and the ball valve 30 are disconnected after the purging operation, if the ball valve 30 is first closed and then the connection room 29 is swiftly separated, it is possible to prevent the replacing gas from leaking from the side of the replacing gas container 3. Alternatively, as shown in FIG. 16(*c*), a male coupler 31 and a female coupler 32, or a female coupler 31 and a male coupler 32 are respectively used at the side of the to-be purged room 1 and the side of the replacing gas container 3. For example, the male coupler 31 is provided at the side of the to-be purged apparatus 1, and the female coupler 32 is provided at the side of the replacing gas container 3. Simultaneously with disconnection of the couplers 31 and 32, the connected room between the couplers 31 and 32 is tightly closed with respect to atmosphere by a plug which is pushed by a spring from both sides and therefore, it is possible to prevent the replacing gas from leaking out. Although the check pin 28 or the male coupler 31 is connected to the to-be purged room 1 side, and the connection room 29 and the ball valve 30 or the female coupler 32 is connected to the replacing gas container 3 side in the present embodiment, the purpose of the present embodiment is achieved if the to-be purged room 1 and the purging apparatus 2 are connected to each other tightly with respect to atmosphere. Therefore, the check pin 28 and the male coupler 31 may be connected to any one of the to-be purged room 1 and the purging apparatus 2, and the connection room 29 or the ball valve 30 and female coupler 32 may be connected to the other. Further, for the purpose to prevent confusion of connecting direction of the replacing gas container 3 side and the gas collecting container 4 side of the to-be purged apparatus 1, it is effective to use a male coupler for the valve 26 at the side of the replacing gas container 3 when a female coupler is used for the valve 26 at the side of the collection container 4, and to use a female coupler for the valve 26 at the side of the replacing gas container 3 when a male coupler is used for the valve 26 at the side of the collection container 4.

Here, since a connected room between the replacing gas container 3 and the to-be purged apparatus 1 is a gas sending outside, the pressure in the connected room may be higher than atmospheric pressure and thus, if the connected room is not opened into atmosphere, it is effective to prevent the replacing gas from leaking out. On the other hand, if a connected room between the gas collecting container 4 and the to-be purged apparatus 1 is closed tightly with respect to atmosphere, it is possible to prevent the replacing gas from leaking out.

With the above structure, when the purging apparatus 2 and the to-be purged apparatus 1 are separated after the purging operation is completed, the inside exchanger gas should not flow out, and it is possible to provide a purging apparatus having a replacing gas container securing the safety while preventing the replacing gas from leaking when the replacing gas includes flammable or toxic material.

Further, when the purging apparatus 2 and the to-be purged apparatus 1 are separated after the purging operation is completed, the inside exchanger gas should not flow out. When the replacing gas includes flammable or toxic material, it is possible to provide a purging apparatus having a gas collecting container 4 securing the safety while preventing a mixed gas including a large amount of to-be purged gas introduced to the gas collecting container 4 side from leaking.

Further, when the purging apparatus and the to-be purged apparatus are separated after the purging operation is completed, the replacing gas in the apparatus should not flow out, and it is possible to provide a to-be purged apparatus securing the safety while preventing the replacing gas when the replacing gas includes flammable or toxic material.

Figure 17:
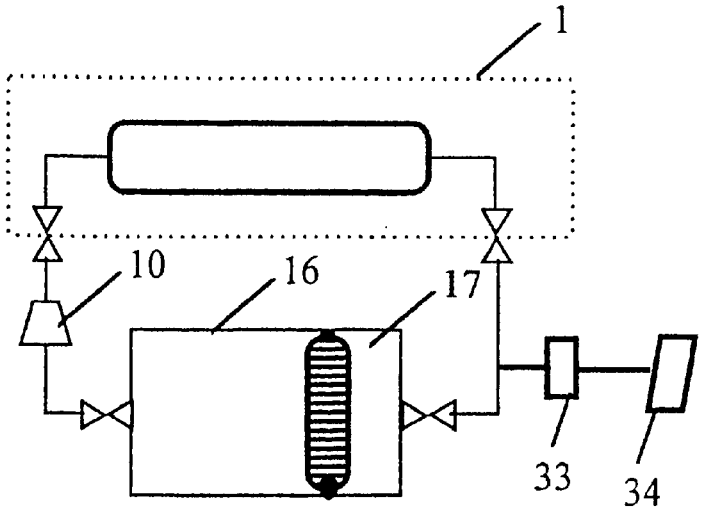
FIG. 17 is a block diagram of the apparatus showing an eighteenth embodiment of the invention.
Figure 18:
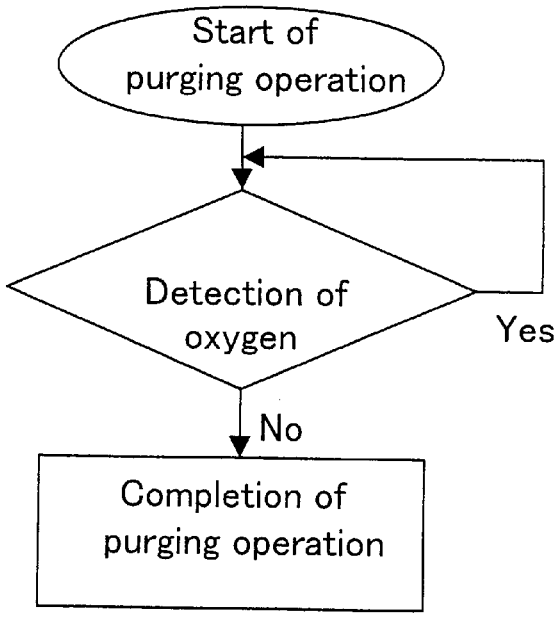
FIG. 18 is one example of a control flowchart of the eighteenth embodiment of the invention.

Next, an eighteenth embodiment of the present invention will be explained with reference to FIGS. 17 and 18. First, as shown in FIG. 17, an oxygen sensor 33 is provided on a connecting pipe between the integral container 16 and the to-be purged apparatus 1 at the side of the collection gas chamber 17, and a microcomputer 34 is provided for receiving a signal from the oxygen sensor 33 to judge the completion of purging operation. Here, the oxygen sensor 33 may be a sensor for indicating that there exists a gas by means of color such as a gas detector tube, and in this case, the microcomputer 34 may be omitted.

Next, the procedure for judging the completion of the purging operation will be explained with reference to FIG. 18. When the purging operation is started, the oxygen sensor 33 is operated simultaneously to detect the gas sent into the collection gas chamber 17. After a short time from the start of the purging operation, air which is the to-be purged gas flows through the oxygen sensor 33, the sensor outputs a signal indicative of "detected". However, the purging operation is progresses and after a gas in the to-be purged room 1 has been completely exchanged for the replacing gas, since the replacing gas passes through the sensor, oxygen is not detected. Therefore, if the oxygen is not detected, it is possible to judge that gas in the to-be purged room has been exchanged for the replacing gas, and to judge the completion of the purging operation.

The control procedure described here is one example, and the present embodiment should not be limited to this example only.

With the above structure, when the to-be purged gas is air as in the air conditioner or gas including oxygen is previously exchanged, the oxygen gas is detected continuously, intermittently or in a spot manner in a passage flowing into the collection container 16, and if the oxygen gas is not detected any more, it is possible to judge that the gas in the to-be purged room is completely exchanged for the replacing gas and therefore, it is possible to carry out the purging operation more reliably.

Figure 19:
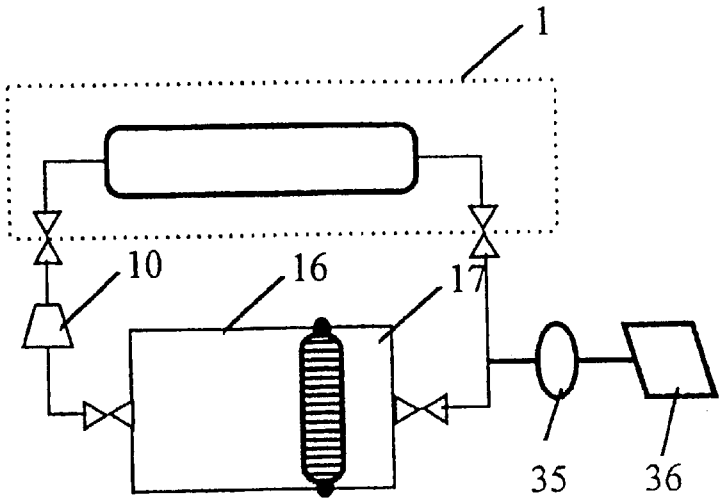
FIG. 19 is a block diagram of the apparatus showing a nineteenth embodiment of the invention.
Figure 20:
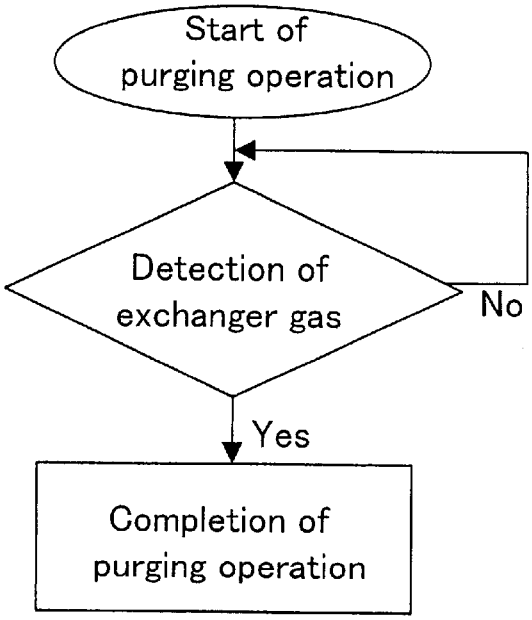
FIG. 20 is one example of a control flowchart of the nineteenth embodiment of the invention.

Next, a nineteenth embodiment of the present invention will be explained with reference to FIGS. 19 and 20. First, as shown in FIG. 19, a replacing gas sensor 35 is provided on a connecting pipe between the integral container 16 and the to-be purged apparatus 1 at the side of the collection gas chamber 17, and a microcomputer 36 is provided for receiving a signal of the replacing gas sensor 35 to judge the completion of the purging operation. If Freon or hydrocarbon is used as the replacing gas, there is a merit that a sensor is more inexpensive and easier to obtain as compared with an oxygen sensor. Here, the replacing gas sensor 35 may be a sensor for indicating that there exists a gas by means of color such as a sensor tube, and in this case, the microcomputer 36 may be omitted.

Next, the procedure for judging the completion of the purging operation will be explained with reference to FIG. 20. When the purging operation is started, the replacing gas sensor 35 is operated simultaneously to detect the gas sent into the collection gas chamber 17. After a short time from the start of the purging operation, air which is the to-be purged gas flows through the replacing gas sensor 35, the sensor outputs a signal indicative of "detected". However, the purging operation is progresses and after a gas in the to-be purged room 1 has been completely replaced with the replacing gas, since the replacing gas passes through the sensor, the replacing gas is detected. Therefore, if the replacing gas is detected, it is possible to judge that gas in the to-be purged room has been exchanged for the replacing gas, and to judge the completion of the purging operation.

Preferably, after the replacing gas is detected, the purging operation is continued for a certain period and then, it is judged that the purging operation is completed, which enhance the reliability.

The control procedure described here is one example, and the present embodiment should not be limited to this example only.

With the above structure, if the gas is detected continuously, intermittently or in a spot manner by the replacing gas detecting means 35 disposed closer to the integral container 16 than the to-be purged room 1, and the replacing gas flowing into the collection gas chamber 17 is detected, it is possible to confirm that the gas in the to-be purged room 1 is sufficiently exchanged for the replacing gas, and it is possible to reliably judge the completion of the purging operation.

Figure 21:
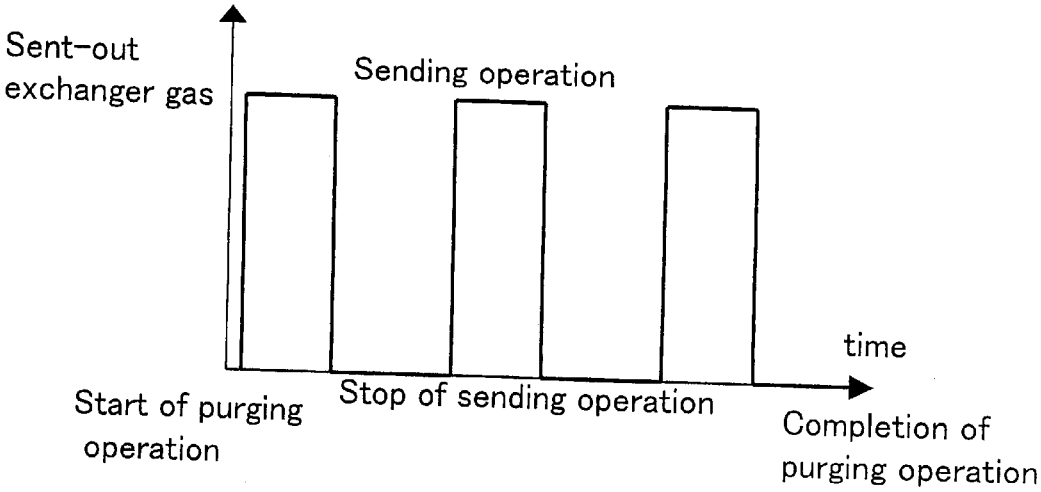
FIG. 21 is a block diagram of the apparatus showing a twentieth embodiment of the invention.

Next, a twentieth embodiment of the present invention will be explained with reference to FIG. 21. The replacing gas is continuously sent out in accordance with a pressure difference if the replacing gas is not especially controlled. However, when a constant flow field is formed, if there is a stagnation portion of non-condensing gas like air locally in the to-be purged room, the air around the stagnation point is not pushed out by the purging operation. Thereupon, if the replacing gas is sent out intermittently as shown in FIG. 21, air around the stagnation point formed when the replacing gas is sent out is dispersed away when the sending operation of the replacing gas is stopped, and such air is pushed out when the replacing gas is sent out next time.

With the present embodiment, the to-be purged gas staying around the stagnation point is dispersed each time to prevent the gas from staying in one place, and it is possible to carry out the exchanging operation more reliably.

Figure 22:
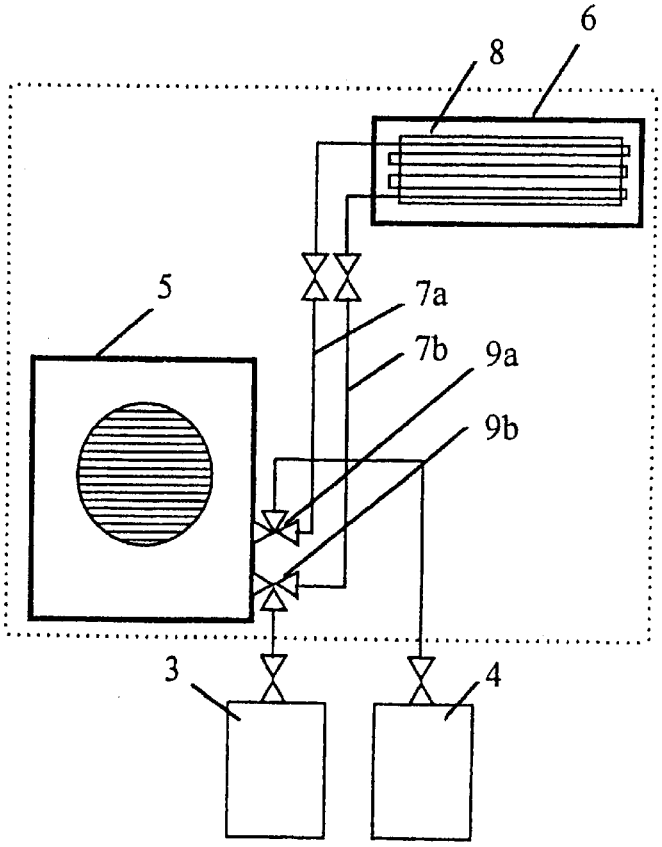
FIG. 22 is a block diagram of the apparatus showing an twenty first embodiment of the invention.

Next, a twenty first embodiment of the present invention will be explained with reference to FIG. 22. FIG. 22 shows a structure of a general air conditioner. The reference number 7*a* represents a liquid pipe and the reference number 7*b* represents a gas pipe. Generally, a pipe diameter of the liquid pipe 7*a* is smaller than that of the gas pipe 7*b*. In this case, if the replacing gas container 3 is connected to the side of a 3-way valve 9*b* to send the replacing gas from the gas pipe 7*b* having the greater diameter, the replacing gas flows more smoothly as compared with a case where the replacing gas container 3 is connected to a 3-way valve 9*a* to send the replacing gas from the liquid pipe 7*a* having the smaller diameter. Further, the possibility that the replacing gas stops or stays around the inflow room is lower, and the purging operation is carried out more effectively.

With the above reason, since the replacing gas is sent out in a form of gas in generally, a pressure drop of the replacing gas in the vicinity of the exit of the replacing gas container 3 is smaller, and the replacing gas can be sent out more smoothly if the replacing gas is sent out from a valve opening having a great diameter as compared with a case where the replacing gas is sent out from a valve opening having a small diameter.

Further, it is possible to prevent a stagnation room due to a swirl which is prone to be generated when a diameter of a pipe is increased from thin pipe to thick pipe from being generated, and it is possible to exchange the gas more effectively.

Figure 23:
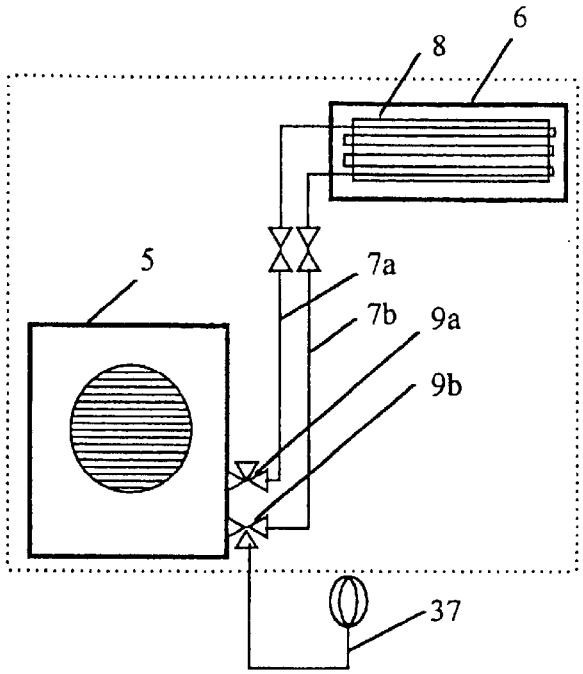
FIG. 23 is a block diagram of the apparatus showing an twenty second embodiment of the invention.

Next, a twenty second embodiment of the present invention will be explained with reference to FIG. 23. A purpose of the present embodiment is to control a charging amount of working fluid to a predetermined amount when a main circuit is operated by controlling a residue amount of the replacing gas remaining in the to-be purged room after the purging operation to a predetermined amount so that an inherent performance as an equipment is maintained. As shown in FIG. 23, the to-be purged room comprising the indoor heat exchanger 8, the connecting pipes 7*a* and 7*b* is purged using, as the replacing gas, a flammable gas which does not generate a harmful material. Then, the purging apparatus is disconnected, one of 3-way valves 9b provided on the outdoor unit 5 is connected to a gas combustion device (such as a torch) 37. Here, the gas combustion device 37 is opened, and the replacing gas in the to-be purged room is ignited under the atmosphere, thereby pulling out and removing the excessive exchanger gas inside the to-be purged portion. When a pressure of the replacing gas in the to-be purged room is reduced down to a level near the atmospheric pressure, flowing out of the combustion gas is stopped, flames are also put out, and the discharge is completed. As a result, the predetermined amount of exchanger gas remains under the pressure near the atmospheric pressure, although such amount is slightly varied depending on temperature in the to-be purged room.

With the present embodiment, the replacing gas in the to-be purged apparatus is burned outside, and is discharged under a reduced pressure, and the pressure can be further reduced to a substantially constant pressure. Therefore, it is possible to control the replacing gas remaining in the to-be purged apparatus to a predetermined value and therefore, when the main circuit is utilized, the amount of the working fluid may be kept constantly, and a predetermined designed capacity can be exhibited.

Figure 24:
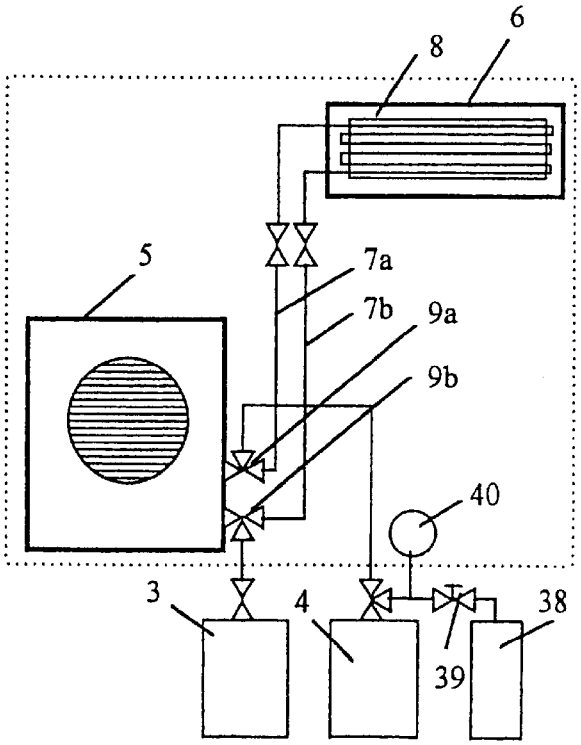
FIG. 24 is a block diagram of the apparatus showing an twenty third embodiment of the invention.
Figure 25:
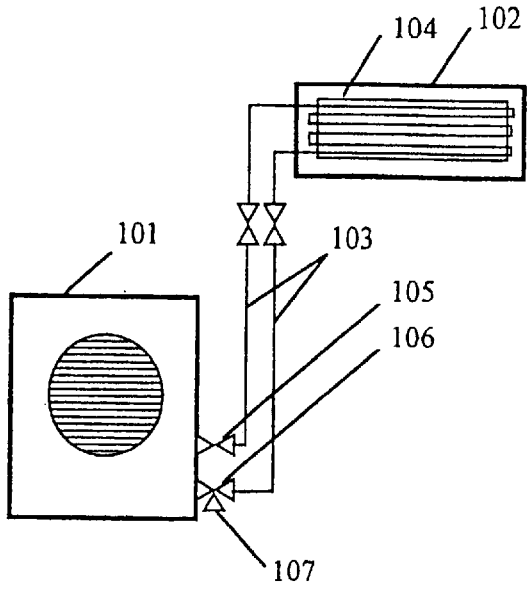
FIG. 25 is a block diagram showing a first conventional example.
Figure 26:
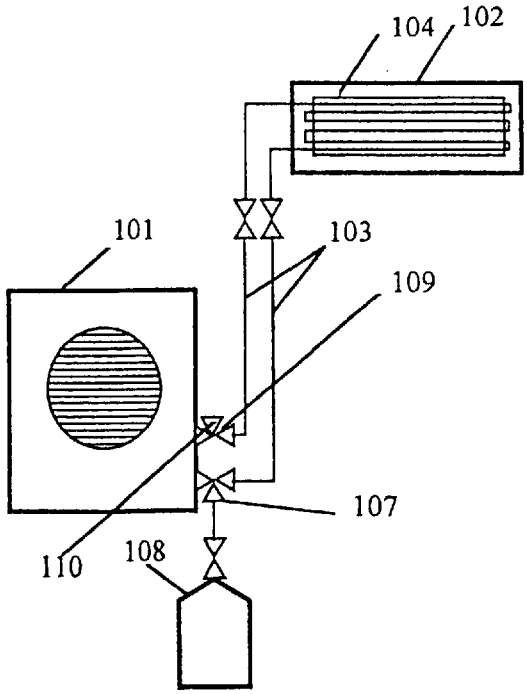
FIG. 26 is a block diagram showing a second conventional example.

Next, a twenty third embodiment will be explained with reference to FIG. 24. A purpose of the present embodiment is also to control a charging amount of working fluid to a predetermined amount when a main circuit is operated by controlling a residue amount of the replacing gas remaining in the to-be purged room after the purging operation to a predetermined amount so that an inherent performance as an equipment is maintained. As shown in FIG. 24, an extra-container 38 is connected in parallel to the gas collecting container 4 through a valve 39, and a pressure gauge 40 capable of measuring the gas pressure in the to-be purged room is also connected to the gas collecting container 4. After the purging operation is completed, a pressure of the replacing gas in the to-be purged room is equal to or higher than atmospheric pressure, the valve 39 is opened after the gas collecting container 4 is closed, and the to-be purged room and the extra-container 38 are brought into communication with each other, at that time, the pressure of the replacing gas in the to-be purged room is reduced and adjusted so that the pressure of the replacing gas reaches a predetermined value, and the pressure reaches the predetermined value, the valve 39. With such operation, the amount of exchanger gas remaining in the to-be purged room is controlled to a predetermined amount.

In order to enlarge a range of the depression adjustment, it is preferable that an initial pressure in the extra-container 38 is a reduced pressure or a vacuum. With the present embodiment, the replacing gas pressure in the to-be purged room can be adjusted with a simple structure, and it is possible to control the amount of exchanger gas remaining in the to-be purged apparatus by the purging operation to the predetermined amount. Further, since the range of adjusting the gas pressure in the to-be purged room can be enlarge, it is possible to adjust the amount of exchanger gas remaining in the to-be purged apparatus by the purging operation more accurately.

Possibility of Industrial Utilization

As is apparent from the above-described embodiments, according to the present invention, when a purging operation is carried out mainly a split-type air conditioner at the time of installation or replacement thereof, it is possible to carry out the purging operation which is kind to the global environment without discharging out and dispersing refrigerant gas which may adversely affect natural environment of human body.

Further, according to the present invention, it is possible to provide light-weighted and inexpensive purging apparatus and to-be purged apparatus which can easily bring to the installing place of an air conditioner or the like, and which can carry out the purging operation more effectively.

What is claimed is:

1. A purging method using: a to-be purged apparatus having a to-be purged room with two or more valve openings capable of connecting to a main circuit or to a circuit other than said main circuit; and a purging apparatus having a replacing gas container into which a replacing gas to be exchanged for a to-be purged gas is previously charged and a gas collecting container for collecting gas including said to-be purged gas, one of said valve openings of said to-be purged room and said exchanger gas container can be connected with each other, and the other valve opening of said to-be purged room and said gas collecting container can be connected with each other; said method comprising the steps of: sending said exchanger gas in said exchanger gas container, thereby pushing out said to-be purged gas in said to-be purged apparatus; and collecting said to-be purged gas into said gas collecting container.

2. A purging apparatus comprising a replacing gas container into which a replacing gas to be exchanged for to-be purged gas is previously charged, and a gas collecting container for collecting gas including said to-be purged gas, one of valve openings of said to-be purged room and said exchanger gas container, and other valve opening of said to-be purged room and said gas collecting container are capable of connecting with each other.

3. A to-be purged apparatus comprising a to-be purged room for exchanging a gas therein for a replacing gas, said to-be purged room having a valve opening for connecting with a main circuit and two or more valve openings for connecting with circuit other than said main circuit, wherein the number of said valve openings is two, and said two valve openings are mounted at opposite ends of a pipe requiring purging.

4. A purging apparatus according to claim 2, further comprising gas moving means for moving said exchanger gas or said to-be purged gas.

5. A purging apparatus according to claim 2 or 4, wherein said gas collecting container is provided therein with a replacing gas adsorbing material for adsorbing said exchanger gas.

6. A purging method according to claim 1, wherein said gas collecting container is evacuated into vacuum or is depressurized.

7. A purging apparatus according to claim 2 or 4, wherein a volume of said gas collecting container is variable.

8. A purging apparatus according to claim 2 or 4, wherein a volume of said exchanger gas container is variable.

9. A purging method according to claim 1 or 6, wherein the same gas as a working fluid of said main circuit is used as said exchanger gas.

10. A purging apparatus according to claim 8, further comprising a value variable driving apparatus capable varying a volume of said exchanger gas container.

11. A purging apparatus according to claim 7, further comprising a value variable driving apparatus capable varying a volume of said gas collecting container.

12. A purging apparatus comprising a replacing gas room, a collection gas room and partitioning means for forming said exchanger gas room and said collection gas room, wherein said partitioning means varies volumes of said exchanger gas room and said collection gas room.

13. A purging apparatus according to claim 12, wherein said exchanger gas room and said collection gas room are integrally formed in a container having a constant cross section, and said partitioning means is slidably movable.

14. A purging apparatus according to claim 12 or 13, further comprising volume variable means for moving said partitioning means.

15. A purging method according to claim 1 or 6, wherein a pressure of said exchanger gas is set to a value equal to 0.0 MPa or greater but smaller than 0.2 MPa.

16. A purging apparatus according to either claim 12 and 13, further comprising pressure detecting means for detecting a pressure of said exchanger gas.

17. A purging apparatus according to either claim 12 and 13, wherein said exchanger gas container or said exchanger gas room is provided with inflow pressure control means capable of controlling inflow pressure of said exchanger gas to be charged.

18. A purging method according to claims 1 or 7, wherein said exchanger gas container or said exchanger gas room is connected to said to-be purged apparatus through water removing means.

19. A purging method according to claim 1 or 6, wherein said exchanger gas container or said exchanger gas room is connected to said to-be purged apparatus through a check valve for stopping the movement of gas in a direction from said to-be purged apparatus toward said exchanger gas container or said exchanger gas room.

20. A purging method according to claim 1 or 6, wherein said gas collecting container or said collection gas room is connected to said to-be purged apparatus through a check valve for stopping the movement of gas in a direction from said to-be purged apparatus toward said gas collecting container or said collection gas room.

21. A purging apparatus according to either claim 12 and 13, wherein a connection room of said exchanger gas container or said exchanger gas room with said to-be purged apparatus has a structure capable of sealing against atmosphere when said connection room is disconnected.

22. A purging apparatus according to either claim 12 and 13, wherein a connection room of said gas collecting container or said collection gas room with said to-be purged apparatus has a structure capable of sealing against atmosphere when said connection room is disconnected.

23. A to-be purged apparatus according to claim 3, wherein a connection room of said to-be purged apparatus with said purging apparatus has a structure capable of sealing against atmosphere when said connection room is disconnected.

24. A purging apparatus according to either claim 12 and 13, wherein said to-be purged gas exists in said to-be purged room is air or gas including oxygen, a connection path between said gas collecting container or said collection gas room and said to-be purged apparatus is provided with oxygen gas detecting means, and said purging apparatus further comprises first purge completion judging means for judging a completion of purging operation based on a signal from said oxygen gas detecting means.

25. A purging apparatus according to either claim 12 and 13, further comprising exchanger gas detecting means disposed in a connection path between said to-be purged apparatus and said gas collecting container or said collection gas room for detecting said exchanger gas, and second purge completion judging means for judging a completion of purging operation based on a signal from said exchanger gas detecting means.

26. A purging method according to claim 1 or 6, wherein said exchanger gas is intermittently sent out from said exchanger gas container or said exchanger gas room.

27. A purging method according to claim 1 or 6, wherein said exchanger gas container or said exchanger gas room is connected to one of connection valves of said to-be purged apparatus having a greater diameter.

28. A purging method according to claim 1 or 6 wherein a flammable gas which does not generate harmful material when it is burned is used as said exchanger gas, and after the gas exchange is completed, the replacing gas in said to-be purged apparatus is burned.

29. A purging apparatus according to either claim 12 and 13, further comprising pressure detecting means disposed in a path extending from said exchanger gas container or said exchanger gas room to said gas collecting container through said to-be purged apparatus for detecting a pressure in said to-be purged room, and a sub-container connected to said path in parallel to said gas collecting container through an on-off valve.

30. A purging method according to claim 1 or 6, wherein said sub-container is evacuated into vacuum or is depressurized.

* * * * *